US007562616B2

(12) United States Patent
Stolten

(10) Patent No.: US 7,562,616 B2
(45) Date of Patent: Jul. 21, 2009

(54) DEVICE FOR THE EMERGENCY LOWERING OF A LOAD-CARRYING MEANS FOR A STACKER TRUCK

(75) Inventor: Thomas Stolten, Tremsbuttel (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 351 days.

(21) Appl. No.: 11/211,334

(22) Filed: Aug. 25, 2005

(65) Prior Publication Data

US 2006/0049688 A1 Mar. 9, 2006

(30) Foreign Application Priority Data

Sep. 4, 2004 (DE) ..... 10 2004 042 881

(51) Int. Cl.
*F15B 13/04* (2006.01)
*F16K 31/44* (2006.01)

(52) U.S. Cl. ..... 91/450; 251/264

(58) Field of Classification Search ..... 91/449, 91/450; 60/403, 481; 251/216, 264, 294
See application file for complete search history.

(56) References Cited

U.S. PATENT DOCUMENTS 3,623,698 A * 11/1971 Couper et al. ..... 251/264
4,630,629 A * 12/1986 Nimberger ..... 251/214
5,065,983 A 11/1991 Slay ..... 254/8 B
5,577,876 A * 11/1996 Haeder et al. ..... 91/449
5,975,496 A 11/1999 Hong et al. ..... 254/2 R
6,086,047 A 7/2000 Lee ..... 254/8 B
6,991,216 B1 * 1/2006 Wilson ..... 251/264
2003/0221548 A1 * 12/2003 Heusser ..... 91/454

FOREIGN PATENT DOCUMENTS

DE 199 16 056 A1 11/1999

* cited by examiner

*Primary Examiner*—Michael Leslie
(74) *Attorney, Agent, or Firm*—Vidas, Arrett & Steinkraus, P.A.

(57) ABSTRACT

Device for the emergency lowering of a load carrying means for a stacker truck, in particular a reach-type forklift truck, with a valve arrangement accommodated in a valve block, via which the inflow and outflow of a hydraulic means is regulated to and from a lift cylinder for the load carrying means, with a bypass between the lift cylinder and a tank, with a barrier element in the bypass. The barrier element is screwed into a threaded bore of the valve block and, in the fully screwed-in position, closes off the bypass branch. One end of a cable transmitting a torque is rotationally fixedly connected to the barrier element and the other end of the cable has a handle for turning the cable.

5 Claims, 2 Drawing Sheets

DEVICE FOR THE EMERGENCY LOWERING OF A LOAD-CARRYING MEANS FOR A STACKER TRUCK

CROSS-REFERENCE TO RELATED APPLICATIONS

Figure 1:
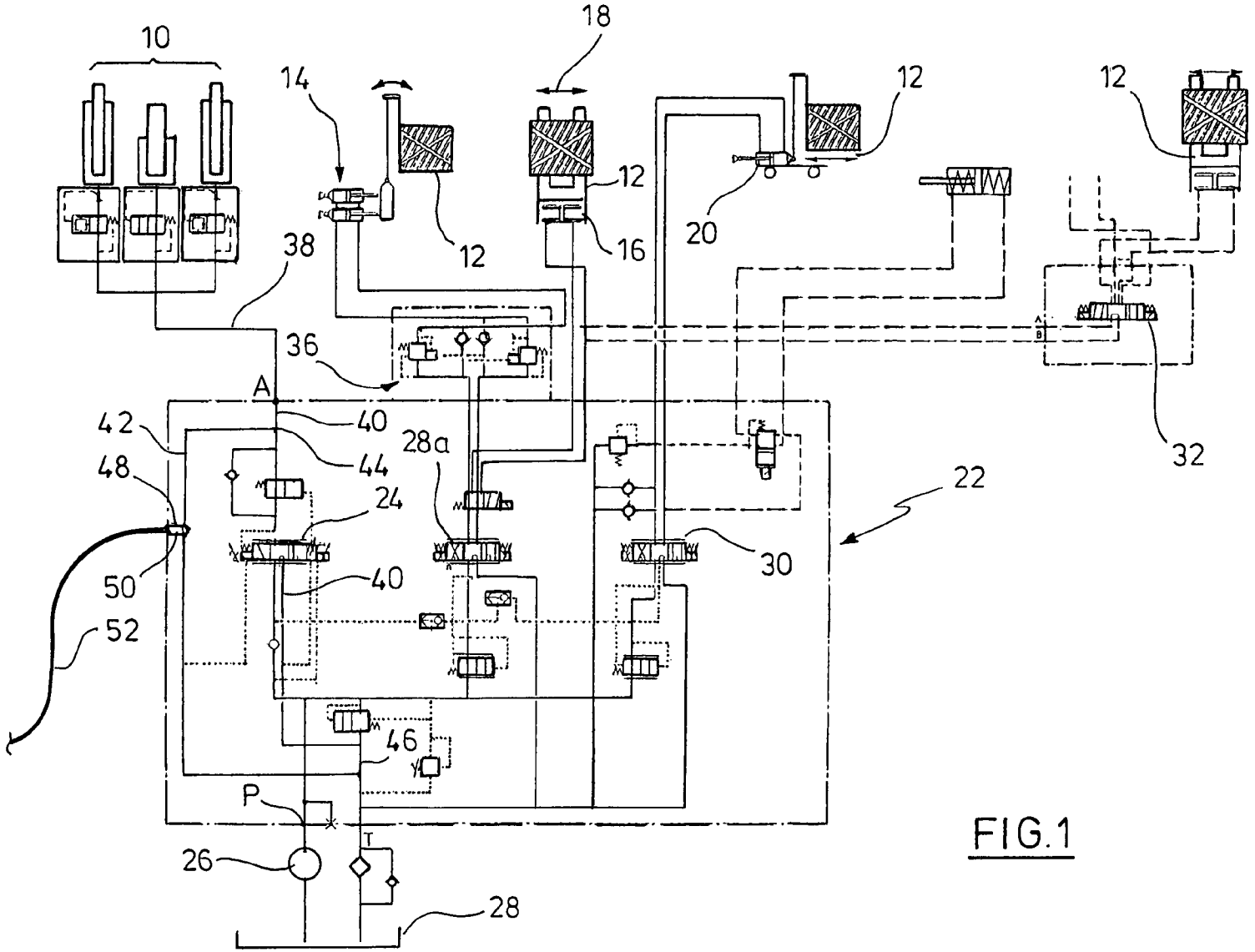

Not applicable.

STATEMENT REGARDING FEDERALLY SPONSORED RESEARCH

Not applicable.

BACKGROUND OF THE INVENTION

The load-carrying means, usually a forklift, is generally raised and lowered by means of at least one hydraulic cylinder. A control valve is connected within the supply line for the hydraulic cylinder in order optionally to hold a load in a raised position, to raise the load or to lower it. It can arise that when the load is raised an error or a failure of the electrical or the hydraulic supply occurs and the operator is not able to lower the load by actuating the control valve. In this case, a device is necessary to initiate so-called emergency lowering.

It is generally known to arrange a line between the hydraulic cylinder and a tank for the hydraulic medium and to connect a check valve therein which usually closes off the line. The check valve may be actuated manually and may be opened in case of emergency, whereby the raised load is safely lowered and the vehicle is brought into a safe condition. The manual valve is located in a region of the vehicle which can be reached by the operator without the risk of it being inadvertently actuated.

It has become known from DE 199 16 056 A1 to arrange a needle valve in a line which is brought into the closed position under spring bias. An actuating lever arranged in a separate box in the driver cab acts via a traction cable (Bowden cable) on a lever linkage which in turn is connected to the needle valve. By actuating the lever, the needle valve may be brought into the open state in order to effect the emergency lowering.

The object of the invention is to provide a device for the emergency lowering of a load carrying means for a stacker truck which may be easily assembled, requires very little space and may be produced by simple means.

BRIEF SUMMARY OF THE INVENTION

In the device according to the invention, the bypass is formed by a bypass branch in the valve block. In the bypass branch, a screw-shaped barrier element with a male thread portion is screwed into a threaded bore of the valve block. In the fully screwed-in position, the bypass branch is consequently closed off. A cable transmitting a torque is rotationally fixedly connected to the end of the barrier element. A handle for turning the cable is attached to the other end of the cable.

According to an embodiment of the invention, the barrier element is configured as a type of grubscrew, which in the known manner comprises a tip which engages in a correspondingly formed recess on the base of the threaded bore, when the barrier element is in the closed-off position. The barrier element may in turn press an element, for example a sphere, against a seat in order to close off the bypass branch.

The cable or the flexible shaft is rotatably mounted in the vicinity of the handle in a fixed aperture. The handle, for example a hexagon, is arranged such that it may be reached by the operator in case of emergency, without the risk of it being inadvertently actuated.

The solution according to the invention has a plurality of advantages. The components required to produce the device are exceptionally simple and small in number. The control cable or the flexible shaft may be installed very easily. The assembly costs are exceptionally low. The entire device has a small space requirement.

The invention is to be described in more detail hereinafter with reference to an embodiment shown in the drawings, in which:

FIG. 1. shows a diagrammatic circuit diagram for a reach-type forklift truck with a device according to the invention.

Figure 2:
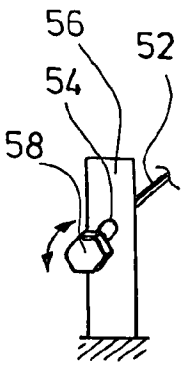

FIG. 2. shows very diagrammatically a handle for the device according to the invention.

Figure 3:
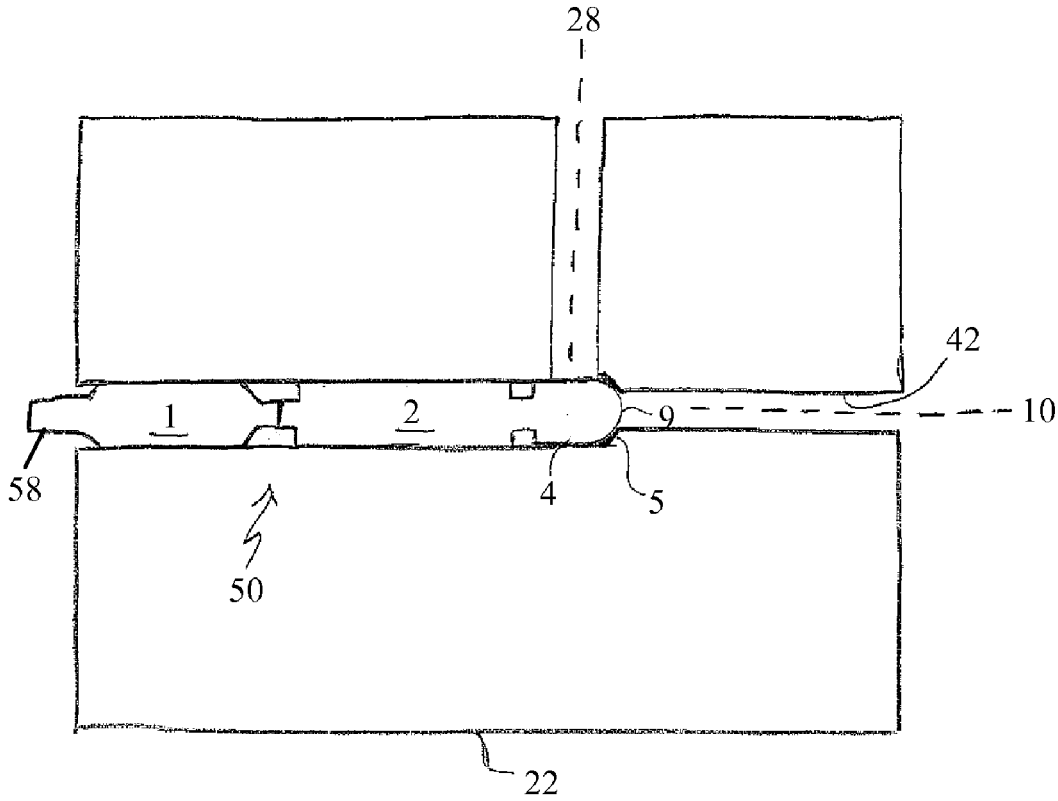

FIG. 3. shows a barrier element and a shut-off element in a threaded bore of the valve block.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated The hydraulic circuit shown in FIG. 1 serves to operate a reach-type forklift truck. Three hydraulic cylinders 10 serve to raise and lower a forklift 12 incrementally and which is shown in the drawing in several operating positions. Two hydraulic cylinders 14 serve to tilt the forklift 12, a double cylinder 16 serves to displace the forklift according to the arrow 18, a further hydraulic cylinder 20 serves to advance the mast, not shown. The side shift cylinder 16 is highlighted once again at the right-hand end of FIG. 1.

The control valve arrangement for actuating the individual hydraulic cylinders is accommodated in a valve block 22. It also contains a control valve 24 for actuating the hydraulic cylinders 10. The hydraulic cylinders 10 are supplied via a pump 26, which suctions the hydraulic medium out of a tank 28. The control valve 24 has three positions, namely a first position for raising the cylinders 10, a neutral position, in which the hydraulic cylinders are closed off from the hydraulic supply and a lowered position in which the hydraulic medium is fed back from the cylinder 10 into the tank 28. This is not described in detail and is also irrelevant to the invention.

A further control valve 28*a* serves to actuate the hydraulic cylinders 14 for tilting. A control valve 30 serves to actuate the hydraulic cylinder for shifting the mast. A control valve 32 serves to displace the forklift 12.

The control valves 24, 28*a*, 30 and 32 are actuated electromagnetically, as known per se. The control valves 24 to 32 and a further valve arrangement 36 are accommodated in the valve block 22. The valve block 22 is a solid, block-like housing which forms or contains a plurality of channels and valves. A line 38 leads from the cylinders 10 via the terminal A into the block 22 in which a channel 40 is formed which leads via the control valve 24 to the terminal P for the pump 26. A second channel 40 leads from the control valve 24 to the terminal T for the tank 28. The other channels and valve arrangements in the valve block 22 are not described further as they generally belong to the prior art.

A bypass channel 42 is provided in the valve block 22 which discharges at 44 into the channel 40 and at 46 into the return flow channel 40. In the valve block 22 a threaded bore 48 is formed into which a barrier element 50 in the form of a grub screw 1 is screwed from the outside. FIG. 3 shows a grub screw 1 threaded into a threaded bore 48. The grub screw 1 actuates a shut-off element 2, which is a sphere, and which is pressed against a seat 5 in the closed position. As shown in FIG. 3, the passage 42 which is connected to a cylinder 1 towards the passage to tank 28 is locked. The left end of grub screw 1 has a hexagon 58 which is connected to an end of the cable (not shown in FIG. 3). In the fully screwed-in position, the grub screw 1, which has a pointed end, seals the channel 42 so that the flow of the medium is closed off in the two directions. If, however, the barrier element 50 is slightly unscrewed, the passage is free and the hydraulic medium may flow back from the cylinders 10 to the tank 28. Thus, in FIG. 3, if the grub screw 1 is threaded out of bore 48, the shut-off element 2 and sealing portion 4 can be moved to the left by the pressure of the medium so that the bypass is open and allows medium to flow from the cylinder arrangement 10 towards the tank 28.

A flexible shaft or a cable 52 is rotationally fixedly connected to the external end of the barrier element 50, via which shaft or cable a torque may be transmitted. It is shown in FIG. 2 how the other end of the cable 52 is rotatably mounted in an aperture 54 of a bearing component 56. A hexagon 58 in the form of a hexagon drive or a hexagon socket is rotationally fixedly connected to the end of the cable 52. By means of the hexagon 58 a torque may be exerted on the barrier element 50 in order to rotate the barrier element 50 out of the closed state into the open state.

The handle 58 is, for example, accommodated in the driver cab (not shown) and indeed such that it may not be actuated inadvertently, but on the other hand may be operated in any operating state of the vehicle.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Device for the emergency lowering of a load carrying means for a reach-type forklift truck, with a valve arrangement accommodated in a valve block, via which the inflow and outflow of a hydraulic means is controlled to and from a lift cylinder for the load carrying means, with a bypass between the lift cylinder and a tank, with a barrier element in the bypass and an actuating device containing a cable which may be actuated by an operator and by means of which the barrier element may be brought in a closed position, the bypass being formed by a bypass branch in the valve block, the barrier element comprising a grub screw which actuates a shut-off element, a male thread of the grub screw being screwed into a threaded bore of the valve block, and in the fully screwed-in position the shut-off element closing the bypass branch, the cable transmitting a torque to being rotationally fixedly connected with one end to the grub screw, and a handle for turning the cable being attached to the other end of the cable.

2. Device according to claim 1, characterised in that the shut-off element is pressed against a seat in the closed position.

3. Device according to claim 2, characterised in that the shut-off element is a sphere.

4. Device according to claim 1, characterised in that the handle is formed by a hexagon (58).

5. Device according to claim 1, characterised in that the cable (52) is rotatably mounted in the vicinity of the handle (58) in a fixed aperture (54).

* * * * *